United States Patent [19]

Murata et al.

[11] Patent Number: 4,788,093

[45] Date of Patent: Nov. 29, 1988

[54] PILE COMPOSITION HAVING EXPANDED FIBERS

[75] Inventors: Shoichi Murata, Takasago; Yoshinori Shibukawa, Himeji; Muneto Makiyama, Kobe, all of Japan

[73] Assignee: Kanegafuchi Kagaku Kogyo Kabushiki Kaisha, Osaka, Japan

[21] Appl. No.: 171,235

[22] Filed: Mar. 22, 1988

Related U.S. Application Data

[63] Continuation of Ser. No. 918,180, Oct. 14, 1986, abandoned.

[30] Foreign Application Priority Data

Oct. 24, 1985 [JP] Japan ..... 60-238255

[51] Int. Cl.[4] ..... B32B 3/02; B32B 33/00

[52] U.S. Cl. ..... 428/97; 428/85; 428/92; 428/93; 428/397; 428/398; 428/401

[58] Field of Search ..... 428/85, 92, 97, 93, 428/401, 398, 397

[56] References Cited

U.S. PATENT DOCUMENTS

| | | | |
|---|---|---|---|
| 3,930,106 | 12/1975 | Mihara et al. | 428/399 |
| 4,012,346 | 3/1977 | Makiyama et al. | 524/40 |
| 4,143,200 | 3/1979 | Radlmann et al. | 428/398 |
| 4,316,937 | 2/1982 | Tanaka et al. | 428/376 |
| 4,425,393 | 1/1984 | Benedyk et al. | 428/401 |
| 4,460,648 | 7/1984 | Kondo et al. | 428/398 |
| 4,576,840 | 3/1986 | Murata et al. | 428/16 |

OTHER PUBLICATIONS

Makiyama, M. et al., Chemical Abstracts, 84:32463(d), 1976.

Radimann, E. et al., Chemical Abstracts, 87:185961(b), 1977.

Kondo, Y. et al., Chemical Abstracts, 94:193621(a), 1981.

Kondo, Y. et al., Chemical Abstracts, 94:158227(e), 1983.

Chemical Abstract, vol. 100, 87143, p. 70.

Chemical Abstract, vol. 91, 124804, p. 62.

Chemical Abstract, vol. 91, 194545, p. 66.

*Primary Examiner*—Sharon A. Gibson

*Attorney, Agent, or Firm*—Armstrong, Nikaido, Marmelstein & Kubovcik

[57] ABSTRACT

The present invention provides pile compositions comprising 2% by weight or more of porous expanded fibers with expansion ratio 3% or higher as fibers composing the pile part. This invention enables providing pile compositions which give excellent animal hair like feeling and external appearance; that is, pile part's lightness, bulkiness, soft touch, elasticity, coloring and loosenability.

4 Claims, 2 Drawing Sheets

PILE COMPOSITION HAVING EXPANDED FIBERS

This application is a continuation of application Ser. No. 918,180, filed Oct. 14, 1986, abandoned.

BACKGROUND OF THE INVENTION

1. Field of the Invention

The present invention relates to pile compositions having expanded fibers and more particularly pertains to pile compositions which provide an animal hair like excellent feeling and external appearance, including light feel, bulkiness, soft touch, elasticity, coloring and loosenability.

2. Description of the Prior Art

Heretofore, in order to obtain pile fabrics which provide animal hair like external appearance and feeling, the material fibers used for pile parts and the finishing process have been investigated, but the target and the present situation are far distanced and in its application on industrial scale, the distance is acutally still larger. For example, as a representative example of material fibers which provide an animal hair like feeling, there have been proposed pile fabrics comprised of fibers with inorganic compounds and cellulose derivatives added with a view to improvement of base materials of fibers by Patent Publication Nos. Sho 56-44163 and Sho 56-44164.

The pile fabric obtained is finished into a pile fabric which gives better lustre, tint and especially soft touch than conventional fibers, but it is inferior to animal hair in the aspects of bulkiness, elasticity, napping and coloring. In the fabrics of Patent Publication No. Sho 43-16896, Utility Model Publication No. Sho 48-15816, Patent Publication No. Sho 52-47053, etc., attempts are made to approach animal hair by providing the shape of monofilament with a taper with a view to improvement in the shape of fiber in its axial direction. In these fabrics, the napped part, being tapered, is improved in touch, but the pile part as a whole is still not adequate in light feel, bulkiness, elasticity, coloring, etc. Further, pile fabrics of fibers having an improved flat section are available on the market, but their quality provides an extra-soft feel and is poor in the aspects of bulkiness, elasticity and coloring. On the other hand, examples of improvement with emphasis placed on feeling aspect, especially, sliminess include Patent Application Nos. Sho 57-28373 and Sho 59-60083, in which the fiber surface is endowed with the sliminess by fixedly forming a film of some feeling improver thereon. In such fibers, appreciable improvement is observed in sliminess, but they are inferior in such aspects as bulkiness, elasticity, soft touch, coloring and loosenability.

SUMMARY OF THE INVENTION

The object of this invention is to provide pile compositions which give animal hair like excellent feeling and external appearance including their pile part's lightness, bulkiness, soft touch, elasticity, coloring and loosenability.

Other objects and advantages of this invention will become apparent from the following detailed description.

The present inventors, as a result of assiduous studies for exploration of causes of problems aforementioned and on the characteristics of animal hair, have had success in solving these problems. Particularly, they discovered that by forming a large number of holes inside the fiber section, excellent features may be splendidly exhibited in animal hair like feeling and external appearance, including light feel, bulkiness, soft touch, elasticity, coloring and loosenability, etc., which discovery has led to solution of the aforementioned problems. Describing the improvements further in detail, by forming a large number of holes inside the fiber section, the fiber's sectional area is increased, so that not only its bulkiness is enhanced, as compared with other fibers of the same composition but having no hole, but in comparison with other pile fabrics having same weight per unit area, it gives light feel and the weight per unit area may be reduced, when the bulkiness is same. Further, with regard to coloring, the transmitted light is scattered by the holes inside the fiber section, giving animal hair like coloring effect, and with regard to pile part's loosenability, the incondensable property is further emphasized to provide improved animal hair like finish for whatever reason.

BRIEF DESCRIPTION OF THE DRAWINGS

FIG. 1 being a electron-micrograph obtained in Example 1;

FIG. 2, that obtained in Example 2;

FIG. 3, in Example 3;

FIGS. 4 and 5, in Example 5; and

FIG. 6, in Comparison Example 1, respectively.

DETAILED DESCRIPTION OF THE INVENTION

Figure 1:
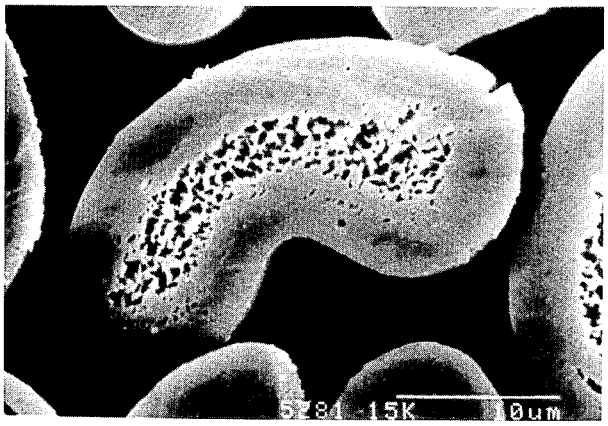
FIGS. 1 through 6 all show scanning electron micrographs of fiber cross-sections, showing the shapes of fibers.

The present invention provides pile compositions containing as the pile part composing fibers 2% by weight or more of porous expanded fibers with expansion ratio 3% or higher.

It is important for the expanded fibers used according to this invention to have 3% or higher, preferably 5% or higher, expansion ratio. The reason is that pile fabrics composed of fibers with expansion ratio not higher that 3%, because of their insufficient expandability, show no distinctive features, as compared with conventional fibers. Thus such fabrics are not much different from the latter in the pile part's feeling aspect expressed by light feel, bulkiness, soft touch, elasticity, etc., coloring and in the loosenability aspect expressed by incondensability of pile part's fibers, etc. The effects will become conspicuous with rising expansion ratios of the fibers. The upper limit for the expansion ratio is not particularly set, it being only proper that the fibers should have sufficiently high monofilament physical properties, e.g., strength, elongation, Young's modulus, etc., so that they can withstand pile knitting and weaving, but it is preferred to be restricted under 100% in practical applications.

The expansion ratio above-mentioned shall be calculated from the following formula:

$$\text{Expansion ratio } (\%) = \{[(B)/(S)] - 1\} \times 100$$

where, (S): Specific gravity of expanded fiber (B): Specific gravity of unexpanded fiber (blank) of a composition formed of the material components of the expanded fiber from which the expander only is removed.

The porous expanded fibers of this invention mean fibers having a large number of holes inside the fiber section, but does not include the porous fibers supposed to be formed by making use of the layer separating effect of mixtures of different types of macromolecules, as indicated by representative examples of Patent Publication No. Sho-18444 and Patent Publication No. Sho 58-43483, or the porous fibers formed by extracting the extractable material which has been added inside the material fibers in their manufacturing process, as shown by a representative example of Patent Laid-Open No. Sho 52-103526, and such hollow fibers as having continuous voids at the center of the fiber, etc. The fibers of this invention should be expanded fibers made porous by bringing gas into the material fibers during their manufacturing process; this process may be combined with one or two or more of the aforementioned two porous fiber manufacturing methods and the method of manufacturing hollow fibers.

The fiber section of the expanded fibers used according to this invention is not particularly limited from the standpoint of the effect of the pile fabric. Generally, the section of the expanded fiber becomes rounded, as compared with the section of a fiber of the same composition but not containing expander, when both are manufactured under the same spinning conditions. If the features of animal hair like pile fabrics are further desired to be especially emphasized, the effect will become notable, when expanded fibers having 2 or higher long axis/short axis ratios of the fiber section are employed. The upper limit of the flatness ratio is not particularly limited, but it should desirably be 15 or lower, judged from the factors of appearance and feeling of the pile fabric. As an expanded fiber whose section is flat is used, the fiber itself looks thick and the elasticity and soft touch which have never been observed in conventional flat fibers which have no hole appears on the pile fabric, for the benefit of its more animal hair like finish. Use as a pile composition of expanded fibers (hereinafter referred to as double structure expanded fibers) whose section is composed of a core part with a lot of holes and walls partitioning them arranged in a spongy appearance and a sheath part having a structure distinguishable from the core part will enable further improvement in the pile fabric's coloring.

Thus such a coloring as seen on animal hair is different from that of conventional synthetic fibers; fiber's thickness feel and luster of fiber surface becomes quite different, depending on the shade, even though they give nearly identical fineness. For example, a fiber which looks thick with opacity emphasized with such light colors as ivory, beige, grey, etc., will appear thin with transparency and lustre on fiber surface added, as the color thickness to brown, black, etc. Then the results of observation of animal hair under an optical microscope and a scanning electron microscope regarding these phenomena have led to the thought that the influence of the core part existing in the animal hair fiber section is large. The reason is that the sheath part having a homogeneous structure and the porous core part having a spongy structure of the animal hair fiber section provide the incident light into the naked eyes reflecting from the animal hair with the complexity of the coloring of the animal hair. Thus with light color, tinting effect is small and fiber's transparency is high; therefore, the incident light passes through the sheath part nearly in a straight line, arriving at the core part, where it is irregularly reflected, giving apparent opaque feel, as experienced when inorganic compounds etc. are added. Conversely, when the color is thick, because of the high tinting effect, most of the incident light is absorbed; as a result, the amount of irregular reflection at the core part decreases, with weakening opaque appearance to the eyes. For these reasons, the pile fabric having a structure like animal hair cross-section i.e., double structure expanded fibers as a pile composition is resembling animal hair especially in coloring.

The core part having a large number of holes and wall surfaces partitioning them arranged in spongy form in the double structure expanded fiber of this invention means a configuration of independent hole or holes communicated to each other, or a large number of these holes in admixture being randomly dispersed or blocked by filmy membranes in the polymer structure being said fiber composition, or yeasty structure, or further, insular structure, etc. The sheath part having a structure distinguishable from the core part does not necessarily mean that it does not contain holes. Thus it is only proper that it is a structure having such a fine grain as to enable its distinguishment from the core part.

The porous expanded fibers used according to this invention may be obtained, for example, by spinning into an aqueous coagulation bath a spinning solution prepared by adding to acrylonitrile base polymer 3–100% by weight on the basis thereof of a compound which is soluble in the organic solvent solution of acrylonitrile base polymer but hardly soluble or insoluble in the coagulation bath for use in wet spinning of said polymer, which is liquid under normal pressure and which has a boiling point of 120° C. or lower, as an expander for the fiber, followed by water-rinsing, and then, forming the spun mixture into a fiber in a dry atmosphere held at a temperature higher than the boiling point of the expander or above 100° C., whichever is higher.

The acrylonitrile base polymers should be polymers copolymerized with acrylonitrile as their main component; for the composition of polymers, copolymers having 25% or more by weight of acrylonitrile are preferable; more preferably, they should have 35–85% by weight of acrylonitrile and still further, preferably 40–60% by weight. Fibers formed of copolymers having less than 25% by weight of acrylonitrile, which are generally not available on the market, are difficult to handle under limitations resulting from various special conditions of finishing and so undesirable.

Monomers copolymerizable with acrylonitrile include: halogenated vinyls and halogenated vinylidenes such as vinyl chloride, vinyl bromide, vinyl fluoride, vinylidene chloride, vinylidene bromide, etc,; unsaturated carboxylic acids such as acrylic acid, methacrylic acid, maleic acid, itaconic acid, etc., and their salts; acrylic acid esters such as methyl acrylate, ethyl acrylate, butyl acrylate, octyl acrylate, methoxyethyl acrylate, phenyl acrylate, cyclohexyl acrylate, etc.; methacrylate such as methyl methacrylate, ethyl methacrylate, butyl methacrylate, octyl methacrylate, methoxyethyl methacrylate, phenyl methacrylate, cyclohexyl methacrylate, etc.; methyl vinyl ketons; vinyl esters such as vinyl formate, vinyl acetate, vinyl propionate, vinyl butylate, vinyl benzoate, etc.; vinyl ethers such as methyl vinyl ether, ethyl vinyl ether, etc.; acrylic acid amide, methacrylic acid amide and their alkyl substitution products; unsaturated sulfonic acids such as styrene sulfonic acid, allylsulfonic scid, methallyl sulfonic acid, etc., and their salts; styrene and its alkyl or halogen substitution products such as styrene, α-methyl styrene, chlorostyrene, etc.; allylalcohol and its esters or ethers; vinyl pyridine, cinyl pyrrolidone and their alkyl substitution products; glycidyl compoinds such as glycidyl acrylate, glycidyl methacrylate, etc.; vinyl compounds such as vinylidene cyanide, acroleinn, methacrylonitrile, etc. One or two or more members of these compounds may be employed.

The aforementioned acrylonitrile base polymers may be obtained by the normal vinyl polymerization method, using as the polymerization initiator such known compounds as, for example, peroxide compounds, azo compounds or various types of redox compounds.

As organic solvents capable of dissolving acrylonitrile base polymers and so generally usable as organic solvents for spinning solutions, dimethyl formamide, dimethyl acetamide, dimethyl sulfoxide, acetonitrile, acetone, etc., may be mentioned; among them, the most preferable solvent to serve the purpose of this invention is acetone. The concentration of the organic solvent solution of acrylonitrile base polymer should preferably be 15–35% by weight.

The expander to be added to the spinning solution should be a compound which is soluble in the organic solvent for said polymer, but which is hardly soluble or insoluble in the coagulation bath and which is liquid under normal pressure and has a boiling point of 120° C. or lower. It should preferably be stable in the presence of acrylonitrile base polymers and organic solvent for said polymers used. Such compounds include; e.g., low aliphatic compounds such as butane, pentane, hexane and heptane or their unsaturated counterparts; low cyclic compounds such as cyclopentane and cyclohexane or their unsaturated counterparts; low halogenated hydrocarbons such as ethyl bromide, propyl chloride, propyl bromide, butyl chloride, butyl bormide, allyl chloride, allyl bromide, dichloroethylene, dichloroethane, trichloroethylene, trichloroethane, etc.; low carboxylic acid esters such as butyl formate, butyl acetate, methyl propionate, etc,; aromatic hydrocarbons such as benzene, toluene, etc.; and freons such as trichloromonofluoromethane, trichlorotrifluoroethane, tetrachlorodifluoroethane, dibromotetrafluoroethane, etc.; one or two or more members of these compounds may be employed. Among them, low aliphatic compounds, cyclic compounds and freons should be preferred and particularly, the effect of hexane or petroleum ether, cyclopentane and trichlorotrifluoroethane is especially excellent. The amount of these expanders to be added should be 3–100%, preferably, 5–50% by weight to the acrylonitrile base polymer, depending on the type of the expander and the solubility of the total amount of its addition to said polymer. In presetting the amount of its addition, arbitrary selection may be made according to the fiber forming state and the fiber cross-sectional state after its spinning as conditions other than the aforementioned type of expander and state of spinning solution after mixed with expander. As the method of adding the expander, a system of directly mixing into the spinning solution tank the expander singly or its mixture with the organic solvent for said polymer or that of mixing either one of them with said spinning solution just before the spinning solution is discharged through the spinning nozzle into the coagulation bath.

For reason of the foaming state of the expanded fiber and from the manfacturing viewpoint, it is not objectionable to add a nucleator to the spinning solution, as required. Used as the nucleator are inorganic powders with mean particle diameters 10 μm or less, preferably, 5 μm or less, and more preferably, 2 μm or less. Such materials include, for example, nonmetal oxides such as boron oxide, silicon oxide, etc.; metal oxides such as aluminum oxide, antimony oxide, zirconium oxide, titanium oxide, zinc oxide, tin oxide, etc.; hardly water soluble or insoluble metal hydroxides and metal chlorides and silicon compounds such as kaolin, talc, bentonite, etc.; but usable nucleators are not limited to these compounds and they may be used singly or in combination of two or more members of them. Further, nucleators of organic compounds may be used; they include such cellulose esters as cellulose acetate, cellulose propionate, cellulose butylate, etc., and their joint use with inorganic particles is also feasible. The amount of these nucleators used is not particularly limited.

The effect of these nucleators is their usefulness in inhibition of local foaming when forming expanded fibers, stabilization of manufacturing process, and particularly, reduction of breakage of filament resulting from local foaming after the drying process. Besides, the cellulose esters have the effect of improving the loosenability of fibers in the pile part, when the expanded fibers are utilized for pile fabrics.

The expanded fiber is formed by discharging the spinning solution prepared in this way into a coagulation bath by semi-dry or wet spinning method. Additives necesary for imparting properties for serving other ends, e.g., stabilizer, organic or inorganic colorant, whitening agent, delustering agent and flame retardant are usable in ranges where they do not interfere with this invention.

Next, in the step of spinning, the spinning solution prepared as above-described is discharged into an aqueous coagulation bath through a nozzle. For the slit configuration of the noozle, round, rectangular and other profiles are available, for which choice may be made to serve the purpose. As for the conditions of coagulation bath, use of aqueous solution of the organic solvent for said polymer for forming the fiber is preferable and the temperature and concentration may be arbitrarily set in the range below the boiling point of the expander, taking account of the coagulation for forming the fiber, solubility of the expander used in the coagulation bath as well as the configuration of the fiber section. Here taking account of the solubility of the expander into the coagulation bath means adopting conditions of making said expander hardly soluble or insoluble in the aqueous solution of the organic solvent. Actually, the solubility of the expander in the coagulation bath should be 100% by weight or less, preferably 5% by weight or less. If the solubility of the expander in the coagulation bath exceeds 10% by weight, the content of the expander is said polymer filament drastically diminshes, resulting in inadequate expanded structure, which is undesirable. If the temperature of the coagulatino bath rises above the boiling point of the expander, the filament of said polymer will begin foaming, but the expanded parts of fibers will collapse or the fibers will fuse together in the later fiber forming process, thus rendering it difficult to obtain satisfactory expanded fibers.

The coagulated filaments of said polymer may be drawn again in the aqueous solution of the organic solvent for said polymer or in air, as required, and then, passed through the next water rinsing process. The temperature for the water rinsing process may be arbitrarily set, irrespective of the boiling point of the expander, but removing the solvent for said polymer from the fibers with the expander left inside the fiber is desirable in forming the fibers. The water rinsing temperature had better be higher for promotion of solvent removal. And if required, the fibers may be drawn in the water rinsing process. The water rinsing temperature should be appropriately set in this water rinsing process, with the type of expander used and the solvent removal from the fiber taken into account, for too abrupt foaming will entail numerous problems in forming fibers.

On filaments obtained in this way, an oiling treatment is made, followed by drying, thereby further promoting the fiber formation. If at this time, the solvent for said polymer exists in more than a certain amount in the water rinsed filament before entering the drying process, fusing between monofilaments takes place, resulting in reduced openability, and static electricity troubles occur. In order to eliminate such problems, deposition of the lubricant which has an antistatic effect should be made. In particular, if the addition of the expander is large in amount, the content of the solvent inside the water rinsed filament which has just been spun is large, resulting in increased fusing between monofilaments in the drying process. To overcome this difficulty, joint use of a lubricant which has large mold releasing effect is desirable and the effect of silicone base lubricant, among other such lubricants, is appreciable. As such silicone base lubricants, there are available denatured polysiloxane, etc., such as epoxy group containing polysiloxane and amino group containing polysiloxane, etc., besides dimethyl polysiloxane, methyl hydrogen polysiloxane and alkoxypolysiloxane. They are used usually in their emulsified form. Especially, epoxy group denatured or amino group denatured silicone base lubricants are preferable from the standpoint of touch improvement of the expanded fibers.

The drying process needs to be run in an atmosphere of drying temperature higher than the boiling point of the expander or 100° C., whichever is higher. If the drying temperature has not reached 100° C., water is left inside the fibers, resulting in degradation of physical properties of fibers and difficulty in the later fiber processing step. If the temperature of the fibers does not rise above the boiling point of the expander during the water rinsing or drying step, inadequately expanded fibers are produced. Then by conducting drawing and heat treatment, expanded fibers excellent in physical properties can be obtained.

Later fiber processing necessitates crimping of fibers. Thus the fibers, having been cut to a specified length, are baled to be delivered to the users. During the shipping, the expanded fibers are subjected to various forms of outside forces. Large forces will collapse the expanded structure parts. It is therefore necessary to be specially careful in processes where the fibers come under outside forces.

The expanded fiber has a cross-section of porous expanded structure. The expansion ratio should preferably be 3% or higher and more preferably, 5% or higher. The reason is because fibers with expansion ratios lower than 3% have no distinct particular features, as compared with unexpanded fibers, because of their inadequate expansion structure; thus, effects due to the expansion structure such as light feel, bulkiness, coloring, rigidity, warmth keeping, etc., can not be expected.

From among pile compositions of this invention, choice may be made of expanded fibers to match characteristic features of hairs of natural animals such as minks, sable, fox, wolf, chinchilla, beaver, rabbit, etc. Thus in accordance with the design of the intended goods, the fiber's fineness, cut length, sectional configuration, coloring, pike density, pile height, etc., may be chosen, or such fibers may be combined with other pile fibers, for example, unexpanded fibers or shrinkable fibers. The proportion of the expanded fibers used in combination with other material fibers is arbitrarily adjustable to the extent where the effects of the expanded fibers are recognized and is not particularly restricted. The tendency of the effect is such that when the light feel is especially desired to be emphasized, their using proportion should be increased, but it may be small, if the object is to emphasize the external pile appearance including coloring. Numerically stated, the proportion occupied by the expanded fibers in the pile should be 2% by weight or higher.

The developing method of the expanded fibers as pile compositions may be arbitrarily chosen to suit the design of goods of the pile fabrics intended to have, as above-described, but by using as the pile compositions thick denier expanded fibers having large flatness ratios for the guard hair part, more animal hair like finish will be provided. With regard to the proportion of the expanded fibers in the guard hair part, if it is small, the expanded fibers look sporadically prominent, which is effective as the so-called visual effect, but if it is large, elements related to feeling are enhanced, resulting in more animal hair like finish. For the down hair part, thin denier fibers or shrinkable fibers, as the case may be, are often generally employed and their use is not particularly restricted by this invention. If the expanded fibers are plentifully used in the down hair part, their feeling will become animal like with the light feel and bulkiness improved. For the expanded fibers for use in down hair part, use of non-shrinkable as well as shrinkable type or types of various cross-sections is permissible, but it is proper to choose any from fibers which serve the purposes. Thus pile fibers each composed of a pile composition containing 2% by weight or more of expanded fibers as fibers which compose the pile excel other fabrics having no expanded fibers in appearance, thus coloring and in loosenability of the pile part fibers and are improved in light feel, bulkiness, soft touch and elasticity, making for their animal hair like effects.

The characteristics and high pile characteristics of the fibers of this invention are measured or evaluated by the following methods:

(i) Specific gravity of fiber

Approx. 0.3 g of sample (opened fibers) was taken an apparent specific gravity of fiber measured, using an automatic hydrometer (Toyo Seiki Seisakusho). The water used at the time of specific gravity measurement was prepared by adding to distilled water a small amount of fluorine base surface active agent and when immersing the sample in it, the immersing was done at a lower speed than that of wetting of the sample due to its capillary phenomenon, lest no bubble be left between fibers. With such care, the measurement was made.

(ii) Expansion ratio

The specific gravity (B) of unexpanded fibers (blank) prepared by removing the expander only from the material composition of expanded fibers and the specific gravity (S) of the expanded fibers were measured by the method of (i) above-described and the expansion-ratio was calculated by Formula (1)

$$\text{Expansion ratio } (\%) = \{[(B)/(S)] - 1\} \times 100 \quad (1)$$

(iii) Flatness ratio

Monofilaments were photographed at a specified magnification from vertically above their cross-section, respectively, using a scanning electron microscope (Hitachi Seisakusho Type S-510). Twenty-five pieces of sample were randomly chosen and measurements were taken of the longer axis length and the shorter axis length of their cross-section and the measured values were averaged out. Then the flatness ratio was calculated by Formula (2):

$$\text{Flatness ratio} = \frac{\text{Longer axis length (average value)}}{\text{Shorter axis length (average value)}}$$

(iv) High pile evaluation

Judgements made by 10 learned persons on external appearance related to surface luster, coloring and loosenability and on feeling related to bulkiness, elasticity and softness of pile goods prepared were evaluated from visual and tactile viewpoint by 4 score method.

The evaluation standard are as follows;

4 Points: Very good

3 Points: Good

2 Points: Rather unacceptable

1 Point: Unacceptable

By summing up the scores taken by evaluation to the above-mentioned standards, comprehensive evaluation was made by the following scheme:

O : 36–40 Points (very good)

○ : 26–35 Points (good)

Δ: 16–25 Points (rather unacceptable)

x: 10–15 Points (Unacceptable)

PREFERRED EMBODIMENTS

In the following, preferred embodiments of this invention are described. The parts and % mean parts by weight and % by weight unless otherwise specified.

EXAMPLE 1

A copolymer comprised of 48.5 parts of acrylonitrile, 50.5 parts of vinyl chloride and 1.0 part of sodium styrene sulfonate was dissolved in acetone; to this copolymer, 40% of 1,1,2-trichloro-1,2,2-trifluoroethane and 0.2% titanium dioxide were added to have the final polymer concentration adjusted to 25%; and the solution was then, stirred at 40° C., yielding the spinning solution. Then this solution was discharged into 20% aqueous solution of acetone at 25° C. through a spinneret with 1000 0.10 mmϕ slits. After immersing therein for 9 sec at a take-up rate of 4.5 m/min, the spun mix was immersed for 6 sec in 25% aqueous solution of acetone, at 30° C., while drawing it 1.8 times, and thereafter, passed through a hot water rinsing bath at 75° C., to undergo expansion, thereby depositing thereon 0.5% of polyether type nonion surface active agent and 0.1% of amino-denatured polysiloxane. Then these filaments, after dried at 120° C., were drawn 2.75 times at this temperature, further subjected to a heat treatment at 145° C. for 5 min and thereafter, crimped. This expanded fiber gave a fineness of 3.2 d and an expansion ratio of 9% and the cross-sectional configuration of the representative fiber was a structure having its core and sheath parts distinguishable as shown in FIG. 1. This fiber was, then, cut to 32 mm, dyed grey by an Overmaier's dyeing machine (using a 0.2% cationic dye), passed through a card and a sliver knitting machine, to be a pile fabric, then, dried at 125° C. with an acrylic acid ester base adhesive applied on the pile back, cut to a pile length of 16 mm through an electro-polisher and a shearing machine and polished into a high pile with finished weight per unit area 670 g/m$^2$.

The evaluation of the high pile thus obtained was, as shown in Table 1, that it had excellent soft feel and bulky touch, that the loosenability of fiber at the pile part was proper, and that its color was dull animal hair like; thus that it was more remarkably animal hair like both in external appearance and feeling, as compared with conventional piles.

EXAMPLE 2

Figure 2:
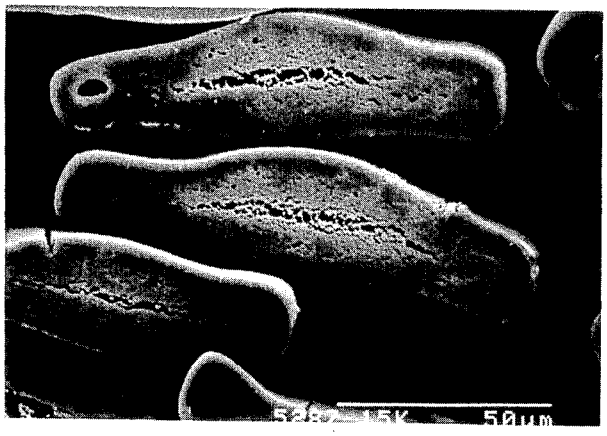

The copolymer used in Example 1 was dissolved in acetone and added with 25% of 1,1,2-trichloro-1,2,2-trifluoroethane and 0.2% of titanium dioxide on the basis of the copolymer, to have the final polymer concentration adjusted to 25% and the mixture was, then, stirred into a spinning solution at 40° C. Then this solution was discharged into a 30% aqueous solution of acetone at 25° C. through a spinneret having 100 rectangular slits with long axis width 0.60 mm and short axis width 0.08 mm, immersed therein for 9 sec at a take-up speed of 4.5 mm/min and then, after immersing in a 25% aqueous solution of acetone for 6 sec, while drawing 1.8 times, passed through a hot water rinsing bath at 75° C., thereby depositing on the spun mix 0.3% of polymether type nonionic surface active agent and 0.05% of amino-denatured polysiloxane. This filament, after being dried at 120° C., was drawn 2.75 times at this temperature, further subjected to a heat treatment at 145° C. for 5 min and then, crimped. This expanded fiber gave a fineness of 20.8d, an expansion ratio of 15% and flatness ratio of 4.2; the cross-sectional configuration of the representative fiber was as shown by the photograph of FIG. 2. Then the fibers, after having been cut to 51 mm, were dyed black (using 3.5% cationic dye) in an Overmaier's dyeing machine, followed by drying; thereafter, 40% of said dyed expanded fibers and 60% of an acrylic fibers "Kanekalon (reg. trademark, the same applies hereinafter)" AHD (10) 4 d, 32 mm (manufactured by Kanegafuchi Chemical Industry Co., Ltd., the same applies hereinafter) were blended and high pile was formed by the steps of Example 1 following the carding. The pile fabric which had been knit by a silver knitting machine was sheared to a pile length of 17 mm and then, after the step with an electropolisher, sheared to 20 mm to a finished high pile having a weight per unit area of 600 g/m$^2$.

The evaluation of the high pile thus obtained was as shown in Table 1 that it gave excellent soft feel and bulky touch, that fiber in the pile part were well loosenable, that its coloring was dull and animal like in tone; thus that it was appreciably animal hair like both in its external appearance and feeling.

EXAMPLE 3

The copolymer used in Example 1 was dissolved in acetone and 10% of n-pentane and 2% of calcium carbonate, on the basis of the copolymer, were added to this solution, to have the final polymer concentration adjusted to 25%. The mixture was, then, stirred at 33° C. into a spinning solution. The spinning solution was discharged into a 20% aqueous solution of acetone at 25° C. through a spinneret having 150 holes with 0.2 mm diameter, the spun mix was immersed therein for 9 sec at a take-up speed of 4.5 m/min and after immersing it for 6 sec in an 20% aqueous solution of acetone at 25°

Figure 3:
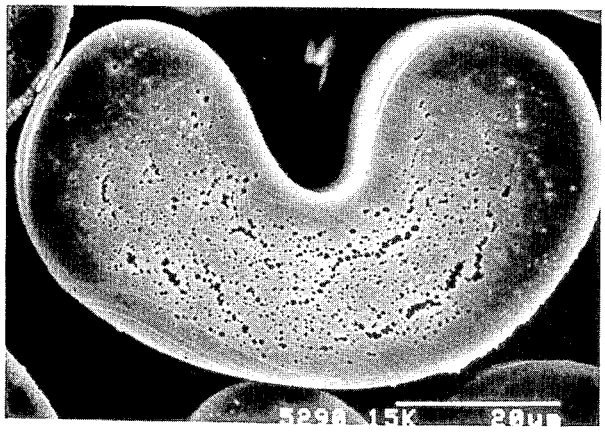

C., while drawing it 1.8 times, passed through a hot water rinsing bath at 75° C., to be expanded, thereby depositing thereon 0.3% polyether type nonionic surface active agent and 0.03% amino-denatured polysiloxane. This filament, after dried at 120°C., was drawn 2.75 times at the same temperature and further subjected to a heat treatment at 145° C. for 5 min. The expanded fibers thus obtained gave a fineness of 20.6d and a expansion ratio of 32% and the cross-sectional configuration of the representative fiber appeared as shown in the photograph of FIG. 3. This fiber was cut to 51 mm. Then 60% of said expanded fibers and 40% of the expanded fibers used in Example 1 were blended into a high pile in accordance with the process of Example 1 following the carding step, except that the pile part length was cut to 25 mm by a shearing machine and the finished weight per unit area was 570 g/m$^2$.

The high pile obtained was, as shown in Table 1, rather poor in soft feel, but proper in bulkiness and loosenability, giving a very light impression, and the pile part was dull, but gave animal hair like feeling and external appearance, with an animal hair like white hair luster.

COMPARISON EXAMPLE 1

Figure 6:
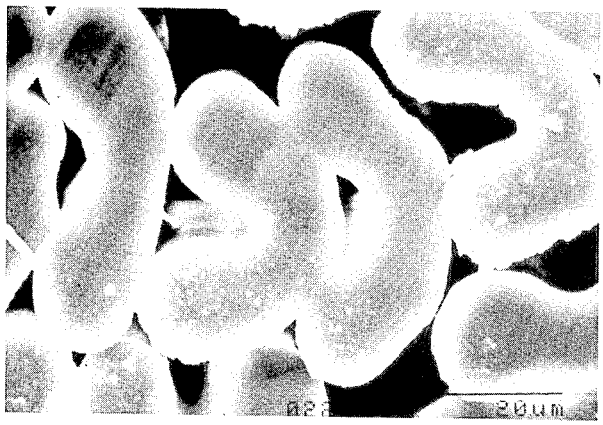

The spinning solution of Example 1 less 1,1,2-trichloro-1,2,2-trifluoroethane was prepared and with it fibers were produced as in Example 1. The fibers obtained gave a fineness of 3.23 d, a specific gravity of 1.29 and the cross-section of the representative fiber shown in FIG. 6. Further, this fiber was finished to a high pile following the process in Example 1.

The high pile thus obtained was lacking in bulkiness and elasticity and although having condensability, surface luster with color tone rather synthetic fiber like and sliminess, gave a feeling and external apperance which were in no way resembling those of animal hairs.

COMPARISON EXAMPLE 2

Acrylic fibers "Kanekalon" RCL 20 d, 51 mm were dyed black similarly as in Example 2 and dried; then, 40% of said dyed fibers and 60% of "Kanekalon" AHD (10) 4 d, 32 mm were blended and finished into a pile similarly as in Example 2.

The high pile thus obtained gave soft feel but was poor in bulkiness and the fibers in the pile part gave pastel like luster and color, as shown in Table 1; thus it was far from being said to be animal hair like.

EXAMPLE 4

Thirty five % of black dyed fiber "Kanekalon" RCL 20 d, 51 mm which was used in Comparison Example 2, 5% of the black expanded fibers used in Example 2 and 60% of "Kanekalon" AHD (10) 4 d, 32 mm were blended and finished into a pile similarly as in Example 2.

The high pile thus obtained, as shown in Table 1, was not much different in soft feel, bulkiness and loosenability, as compared with Comparison Example 2, but visually gave the effect in color of mixing some animal hairs with the expanded fibers, thus giving a remarkable coloring effect.

COMPARISON EXAMPLE 3

Sixty % of acrylic fibers "Kanekalon" SL 24 d, 51 mm and 40% of the same fibers "Kanekalon" SL 3 d, 32 mm were blended and finished into a pile similarly as in Example 3.

The high pile thus obtained was inferior to that of Example 3 in all properties of soft feel, bulkiness and loosenability, as shown in Table 1.

EXAMPLE 5

Figure 4:
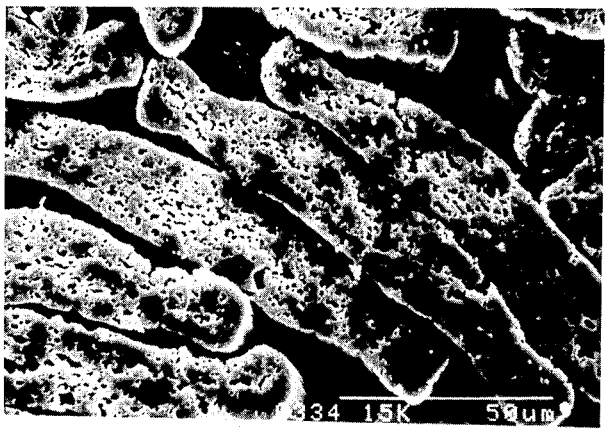
Figure 5:
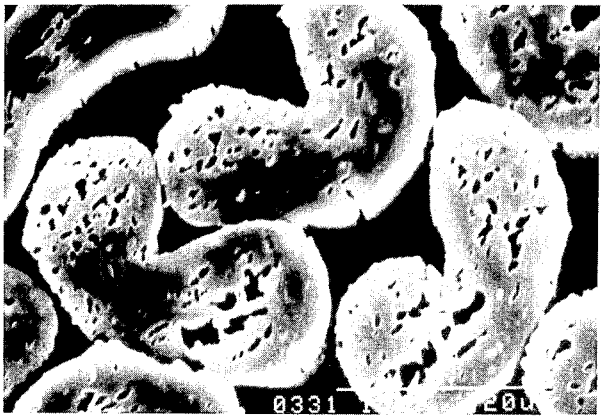

The copolymer used in Example 1 was dissolved in acetone and to this solution, 12.5% of 1,1,2-trichloro-1,2,2-trifluoroethane, 4% of cellulose acetate (degree of acetylation 55%), 0.5% of titanium dioxide and 5% of aluminium hydroxide, on the basis of the copolymer, were added to have the final polymer concentration adjusted to 24.5%; the mixture was, then stirred at 40° C. into a spinning solution. Then using a spinneret A (having 400 rectangular slits with its longer axis width 0.60 mm and its shorter axis width 0.08 mm) and another spinnert B (having 3000 holes with 0.11 diameter), respectively, spinning, drying, drawing and heat treatment and crimping were carried out, in accordance with the spinning conditions of Example 1, whereby expanded fibers with fineness 20 d, expansion ratio 12% and cut length 51 mm (the fiber section is shown in FIG. 4) and expanded fibers with fineness 3 d, expansion ratio 12% and cut length 38 mm (the fiber section is shown in FIG. 5) were respectively obtained. Then 60% of the 20 d expanded fibers and 40% of the 3 d expanded fibers thus obtained were blended and the blended fibers were processed as in Example 3 in the steps following the carding, yielding a high pile with a finished weight per unit area 610 g/m$^2$.

The high pile thus obtained gave good soft touch and highly bulky feel and the fibers in the pile part gave proper loosenability and animal hair like white hair luster; thus animal hair like feeling and external appearance were apparent.

TABLE 1

| | Tactile feel | | Visual feel | |
|---|---|---|---|---|
| | Soft touch (1) | Bulkiness (2) | Luster and coloring | Loosenability (3) |
| Example 1 | ◎ | ○ | Animal hair like color tone | ○ |
| Example 2 | ○ | ○ | Animal hair like color tone | ○ |
| Example 3 | Δ | ◎ | Animal hair like white hair luster | ○ |
| Example 4 | ○ | x | Natural feel was produced with an animal hair like luster scattered in pastel tone guard hair. | ○ |
| Example 5 | ○ | ○ | Animal hair like white hair luster | ◎ |
| Comparison Example 1 | ○ | x | Somewhat dull | x |
| Comparison Example 2 | ○ | x | Pastel tone | ○ |
| Comparison Example 3 | x | x | Full dull | x |

(1) Soft touch: ○Very good in resilient animal hair like soft touch, Δ rather poor, x Poor (Highly yielding or conversely highly rigid)
(2) Bulkiness: ○Very good in voluminousness and elasticity, ○ Good, x Poor
(3) Loosenability: ○Very good without allowing the fibers in the pile part to be tuftily condensed, ○ Good, x Poor because fibers are tuftily condensed.

EXAMPLE 6

Expanded fibers were prepared under the same conditions as in Example 1 except that the expander 1,1,2-trichloro-1,2,2-trifluoroethane used in Example 1 was changed to n-pentane and then, a high pile was produced therewith.

Evaluations of the high pile thus obtained, as given in Table 2, gave improved bulkiness and loosenability, as compared with Comparison Example 1.

TABLE 2

| Amount of n-pentane added to polymer (%) | Expansion ratio (%) | Bulkiness (4) | Loosenability (5) |
|---|---|---|---|
| 5 | 12 | ○ | ○ |
| 10 | 19 | ◎ | ○ |
| 15 | 25 | ◎ | ○ |
| 20 | 35 | ◎ | ○ |

The evaluation standards for (4) and (5) are identical with those for the bulkiness and loosenability of Table 1.

EXAMPLE 7 AND COMPARISION EXAMPLES 4–5

Expanded fibers (A) obtained similarly as in Example 3 but by adding 20% of n-pentane and fibers (B) and (C) produced without addition of expander were cut to 51 mm, to be guard hair fibers.

Using blended fibers of 80% of each the fibers (A), (B) and (C) and 20% of "Kanekalon" AHP 4 d, 38 mm cut length, a high pile was produced in accordance with the high pile forming process of Example 3, except for the fibers in the pile part being finished to 27 mm.

The evaluation results were as shown in Table 3, thus the high pile containing the expanded fibers gave excellent light feel, loosenability and moderate bulkiness.

TABLE 3

| | Guard hair fiber | Fineness (d) | Expansion ratio (%) | Weight per unit area of pile (g/m$^2$) | Light feel (6) | Loosenability (7) | Builkiness (8) | Luster |
|---|---|---|---|---|---|---|---|---|
| Example 7 | (A) | 15 | 32 | 510 | ○ | ◎ | ○ | Full dull with surface luster |
| Comparison Example 4 | (B) | 16 | 0 | 500 | x | x | x | Semi-dull with surface luster |
| Comparison Example 5 | (C) | 20 | 0 | 500 | x | x | Δ | Semi-dull with surface luster |

(6) Light feel: ○ Pile part is napped, well draped and gives impression of being light, which are preferable. x Pile part gave yielded and plumpy appearance, giving rise to heavier impression in comparison with others having same degree of pile weight per unit area, which are objectionable.
(7) Loosenability: The evaluation standards are as given under the column of loosenability in Table 1.
(8) Bulkiness: ○ Good with proper soft touch and voluminous appearance. Δ Rather poor with the pile part being rigid and giving a coarse hard voluminous feel.x Unacceptable because of heavy yielding.

What is claimed is:

1. Animal hair-like pile compositions comprising 2% by weight or more of porous expanded fibers formed of acrylonitrile-based polymers with expansion ratios greater than or equal to 3% through gas contained in the fibers during their manufacturing process and less than or equal to 98% weight of non-porous expanded fibers as the fibers comprising the pile part.

2. The pile compositions according to claim 1, wherein the longer axis/shorter axis ratio of the section of the expanded fibers is 2 or higher.

3. The pile compositions according to claim 1 or 2, wherein the section of the expanded fibers is formed of a core part having a large number of holes and wall surfaces partitioning them arranged in a spongy state and a sheath part having a structure which is distinguishable from the core part's structure.

4. The pile compositions according to claim 1 or 2, wherein the expanded fibers are obtained by spinning into an aqueous coagulation bath a spinning solution prepared by adding as an expander of fibers 3–100% by weight, on the basis of acrylonitrile base polymer, of a compound which is soluble in the aforementioned solution, but is hardly soluble or insoluble in a coagulation bath for wet spinning of said polymer, which is liquid under the normal pressure and which has a boiling point of 120° C. or lower, followed by water rinsing and then, forming the spun mix into fibers in a dry atmosphere at a temperature higher than the boiling point of the expander or 100° C., whichever is higher.

* * * * *